United States Patent [19]

Hilado

[11] Patent Number: 4,485,636

[45] Date of Patent: Dec. 4, 1984

[54] CONTAINER WITH COOLING CAPABILITY

[76] Inventor: Rolando V. Hilado, 2725 Pam Pl., West Covina, Calif. 91792

[21] Appl. No.: 550,396

[22] Filed: Nov. 10, 1983

[51] Int. Cl.[3] ..... F25D 11/00

[52] U.S. Cl. ..... 62/430; 62/457

[58] Field of Search ..... 62/457, 371, 372, 529, 62/530, 430

[56] References Cited

U.S. PATENT DOCUMENTS

| | | | |
|---|---|---|---|
| Re. 26,724 | 11/1969 | Paquin | 62/457 |
| 2,032,130 | 2/1936 | Jurkat et al. | 62/457 |
| 2,622,415 | 12/1952 | Landers et al. | 62/457 |
| 3,161,031 | 12/1964 | Flannery | 62/457 |
| 3,205,677 | 9/1965 | Stoner | 62/457 |
| 3,205,678 | 9/1965 | Stoner | 62/457 |
| 3,360,957 | 1/1968 | Paquin | 62/457 |
| 3,394,562 | 7/1968 | Coleman | 62/457 |
| 3,605,433 | 9/1971 | Strathaus | 62/371 |
| 3,715,895 | 2/1973 | Devlin | 62/457 |
| 4,357,809 | 11/1982 | Held et al. | 62/457 |

*Primary Examiner*—Lloyd L. King

*Attorney, Agent, or Firm*—Harris, Kern, Wallen & Tinsley

[57] ABSTRACT

A container for cooling and/or keeping cold beverages and/or foods. The container has a double-walled structure, forming a refrigerant cavity for holding a fluid, such as water, which, when frozen, produces cooling of the beverage or food in the container. A stress-relieving diaphragm accommodates the expansion of the fluid upon chilling to prevent breakage of the container.

14 Claims, 4 Drawing Figures

CONTAINER WITH COOLING CAPABILITY

BACKGROUND OF THE INVENTION

1. Field of Invention

This invention is directed to cooling containers for beverages and other foods. More specifically, it is directed to double-walled containers that hold a quantity of a chillable or freezable fluid, typically water, between the walls, which can be cooled or frozen without damage to the container. Once frozen, the container cools and keeps cold beverages or foods.

2. Description of Prior Art

Fruit juices, soft drinks and other beverages that are drunk cold are generally served with ice cubes in them to make or keep them cold. A disadvantage of this practice is that only a limited amount of ice can be used in the beverage container, there being a trade-off between the amount of ice used and the amount of the beverage desired. Another disadvantage is that, as heat is transferred from the beverage to the ice, the ice melts, diluting the beverage.

A present practice that avoids these disadvantages is the chilling or frosting of mugs or other containers, so that the beverage may be kept cold by means of contact with the container itself. The disadvantage to this "chilled mug" method is that the container warms up relatively quickly, and therefore its usefulness in keeping the beverage cold is short-lived.

Thermos or other double-walled containers with dead air or vacuum cavities keep beverages cold for relatively long periods. Because such containers depend upon the insulating effect of the air or vacuum, however, they cannot be kept open for appreciable lengths of time, because the insulating effect is frustrated by contact of the beverage with room-temperature air. Moreover, such Thermos-type containers are passive only; that is, they can maintain the temperature of a beverage, but are not useful for chilling a warm beverage.

Some devices utilize a liquid refrigerant in a cavity within the containers, but include air space within the cavity to accommodate expansion of the refrigerant upon freezing. A distinct disadvantage of this type of arrangement is that such devices must be frozen upside-down, since the sides freeze before the bottom; if frozen upright, the air space is at the top of the refrigerant cavity, and the lower end of the vessel will rupture upon freezing of the mass of refrigerant at the bottom. Moreover, in these devices the air space in the refrigerant cavity constitutes some 15–20% of the total volume of the cavity, thereby limiting the amount of volume available for refrigerant, and in fact displacing the refrigerant with an insulating material, decreasing the cooling effectiveness of the container.

A cooling container utilizing a fluorinated hydrocarbon as a refrigerant, as in the device of J. R. Coleman disclosed in U.S. Pat. No. 3,394,562, is undesirable for beverages, because of the danger that the toxic refrigerant will leak into the beverage. The Coleman device cannot be utilized with an aqueous refrigerant because no stress-relieving mechanism is provided to accommodate expansion upon freezing.

The cooling arrangement disclosed by Held, et al. in U.S. Pat. No. 4,357,809 uses a compressible styrene to accommodate expansion of a solid gel refrigerant. The Held device cannot be used with an aqueous refrigerant because the refrigerant diffuses into the styrene, causing the styrene to lose its compressibility, and rupture of the container may result. Furthermore, insulating vacuum pockets would form in the refrigerant cavity, lessening the cooling effectiveness.

It is therefore an object of this invention to provide a double-walled cooling container for beverages and other foods with a fluid refrigerant in the cavity formed by the double-walled structure, such that when the container is chilled or frozen, a stress-relieving mechanism will accommodate the consequent expansion of the refrigerant with neither permanent deformation of the mechanism nor damage to the container.

Another object of this invention is to provide a cooling container for beverages that vitiates the necessity of using ice to cool the beverages, allowing for a rapid and longer lasting cooling effect without dilution of the beverage.

Another object of this invention is to provide a cooling container that can be frozen in any position without damage to the container.

Another object of this invention is to provide a cooling container with a refrigerant cavity that contains no air or vacuum, allowing for greater cooling effectiveness.

Another object of this invention is to provide a cooling container that uses a non-toxic liquid as its refrigerant.

Other objects, advantages, features and results will more fully appear in the course of the following description.

SUMMARY OF THE INVENTION

A double-walled cooling container for beverages and/or foods with a cavity containing a fluid refrigerant and no air or vacuum. The bottom of the cavity is formed by a resilient diaphragm, which compresses reversibly upon expansion of the refrigerant due to freezing. The inner and outer walls of the double-walled structure forming the refrigerant cavity preferably are tapered outwardly from top to bottom so that the refrigerant will begin to freeze at the top, where it is the thinnest, such that force due to expansion of the refrigerant will compress the resilient diaphragm rather than rupture the container, independent of the position in which the container is frozen.

DESCRIPTION OF THE PREFERRED EMBODIMENTS

Figure 1:
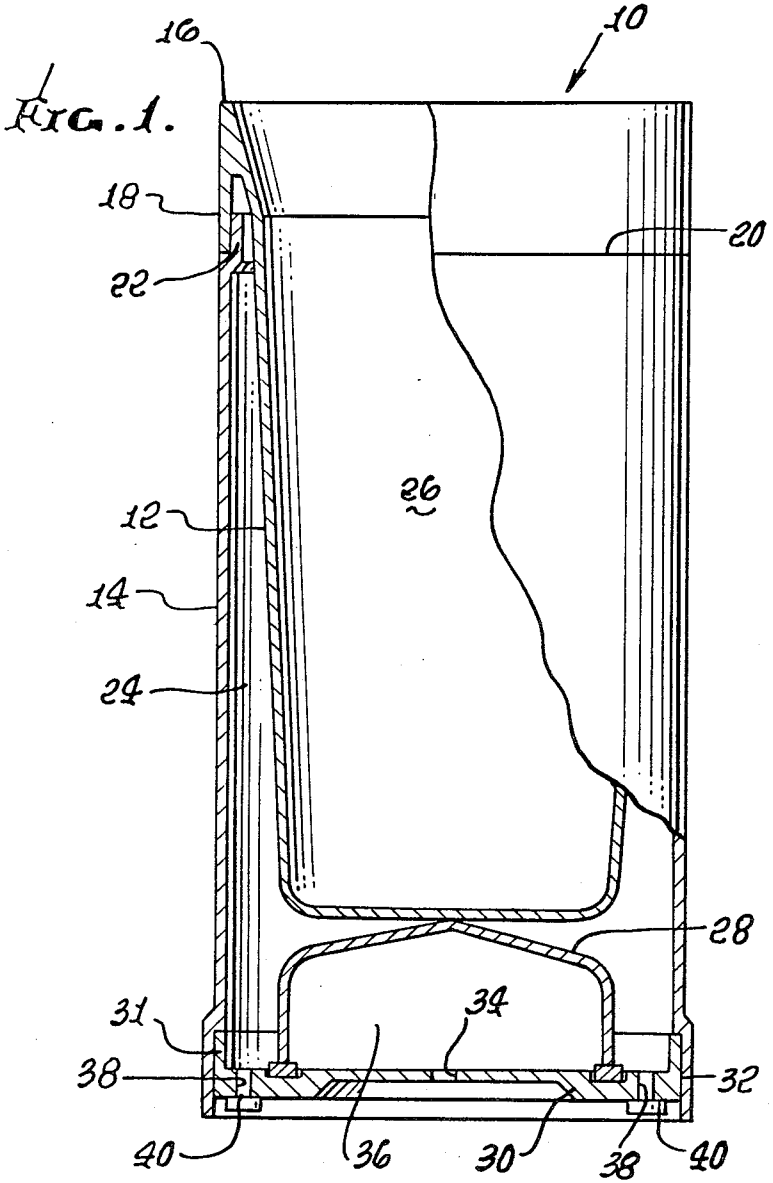
FIG. 1 is an elevation, partly in section, of a drinking glass incorporating the presently preferred embodiment of the invention.

The preferred embodiment of the invention is indicated in FIG. 1, an elevation partly in section.

The cooling container 10 comprises an inner wall 12 and an outer wall 14, the inner wall 12 extending upwards to form an upper rim 16 of the container. The upper rim 16 has an annular depending flange 18 which is joined at annular junction 20 to an annular flange 22 extending upwardly from the outer wall 14. The joining may be accomplished by any appropriate means, such as with a cyanoacrylate adhesive.

In this preferred embodiment the inner wall 12 is generally fructo-conical in shape and the outer wall 14 is generally cylindrical in shape, forming an annular refrigerant cavity 24 which tapers or expands in volume from top to bottom of the container 10. The inner wall 12 is cup shaped to form a receptacle 26 for receiving beverages. Alternative combinations of shapes for the inner wall 12 and the outer wall 14 may be used, such as in FIGS. 2 and 3.

A resilient diaphragm 28 such as a cup-shaped unit is disposed on a base 30 which includes an ascending flange 31 connected by appropriate means, such as an adhesive, at annular junction 32 to the outer wall 14. The diaphragm 28 may be made of any nonporous, flexible, reversibly deformable material such as rubber or plastics such as vinyl.

The base 30 may include one or more air ports 34 to allow exhaustion of air from within the diaphragm cavity 36 upon compression of the cup-shaped unit 28 as the refrigerant in the refrigerant cavity 24 expands upon being frozen.

The base 30 is provided with one or more refrigerant ports 38 to allow the refrigerant cavity 24 to be filled at time of manufacture.

The refrigerant cavity 24 is filled by first inverting the cooling container 10, which is completely assembled except for the insertion of plugs 40. The plugs preferably are the length of the refrigerant ports 38, so that each plug fills the port into which it is inserted without extending into the refrigerant cavity 24. A refrigerant is introduced by means of a syringe or tapered nozzle through one or more of the refrigerant ports 38, allowing any air within the refrigerant cavity 24 to escape through another refrigerant port or ports 38. Although a single refrigerant port 38 may be used both for introducing the refrigerant and for allowing air to escape, the filling process will be expedited if two or more ports are used. Enough refrigerant is introduced into the refrigerant cavity 24 to fill same but not to extend into the volume described by the refrigerant ports 38, which volume is to be filled by the plugs 40, as aforementioned. Preferably the refrigerant fluid is a liquid, such as water or an aqueous solution.

After the refrigerant cavity is filled, the plugs 40 are inserted into the ports 38, an appropriate adhesive being deposited therebetween to make the connection permanent.

Figure 2:
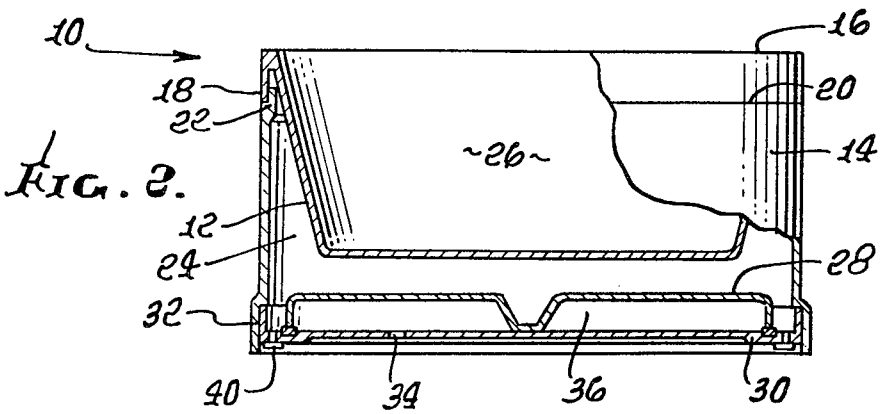
FIG. 2 is an elevation, partly in section, of a salad bowl incorporating an alternative embodiment of the invention.

FIG. 2 shows an alternative embodiment of the invention wherein elements corresponding to those of FIG. 1 are identified by the same reference numerals. This embodiment is in the general shape of a bowl, in which the inner wall 12 generally fructo-conical in shape and upwardly concave for receiving foods in receptacle 26. The outer wall 14 is generally cylindrical in shape, and the resilient diaphragm is in the general shape of an annular cylindrical cup-shaped unit 28, forming an annular diaphragm cavity 36. This embodiment is manufactured and filled with refrigerant in essentially the same manner as the embodiment of FIG. 1.

Figure 3:
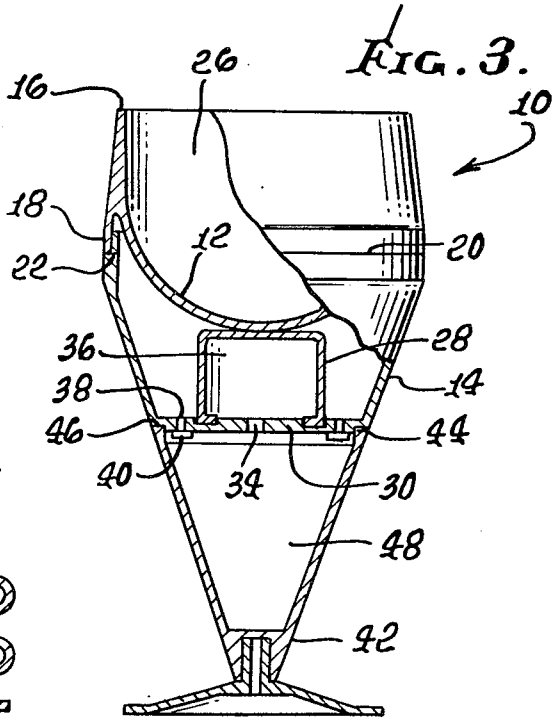
FIG. 3 is an elevation, partly in section, of a wine glass incorporating an alternative embodiment of the invention.

FIG. 3 shows another alternative embodiment of the invention in the general shape of a wine glass, with elements corresponding to those of FIGS. 1 and 2 designated by the same reference numerals. The inner wall 12 is generally hemispherical in shape and upwardly concave for receiving food or drink in receptacle 26. The outer wall is generally fructo-conical in shape and upwardly concave, the resilient diaphragm is in the form of a cylindrical cup-shaped unit 28 and is upwardly convex, and the base 30 and the outer wall 14 are formed of a single piece of material at manufacture. This embodiment also includes a sub-base 42 which has an ascending flange 44 which is attached by an adhesive to base 30 at annular junction 46. The sub-base 42 may form an air cavity 48 which is in communication with diaphragm cavity 36 through the air port or ports 34.

The embodiment of the invention in FIG. 3 is filled with refrigerant and sealed at ports 38 by plugs 40 in the manner hereinbefore described with respect of FIG. 1. After the plugs 40 are attached, the sub-base 42 is then attached by an adhesive to the base 30, completing the manufacture.

Figure 4:
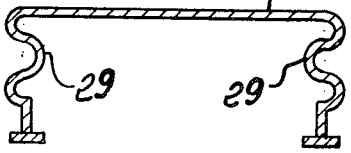
FIG. 4 is a sectional elevation of an alternative embodiment of the resilient diaphragm of the drinking glass of FIG. 1.

FIG. 4 shows a resilient diaphragm in the form of a bellows 28', with pleats or corrugations 29 along the circumference thereof, as an alternative embodiment of the diaphragm in the form of a cup-shaped unit 28' of FIG. 1. The bellows 28 of FIG. 4 is the functional equivalent of the cup-shaped unit 28 of FIG. 1, is disposed on the base 30 in the same manner, and is likewise made of a nonporous, flexible, reversibly deformable material. When the resilient diaphragm takes the form of a bellows, expansion of the refrigerant causes compression of the bellows at corrugations 29.

It will be appreciated that the resilient diaphragm of FIGS. 2 and 3 may also be bellows rather than the cup-shaped units shown in these embodiments. Such bellows may take the same general shape as the cup-shaped units in FIGS. 2 and 3, with the addition of corrugations along the circumference thereof, in the same fashion as the bellows 28' of FIG. 4.

Other configurations of the container of the invention may be made which utilize the concepts behind this invention. For example, a pitcher or mug may be formed by attaching a handle to the outer wall 14 in the embodiment of the invention as shown in FIG. 1. A plate may be formed by manufacturing the embodiment shown in FIG. 2 such that the height of the outer wall 14 is small relative to the diameter of the base 30. An "old-fashioned" drink glass may be formed from the embodiment of the invention shown in FIG. 3 by manufacturing said embodiment without the sub-base 42.

Various modifications and alternative embodiments of the foregoing disclosure may be made without departing from the spirit and scope of this invention.

I claim:

1. A double-walled cooling container for beverages and/or foods comprising:

an inner wall for receiving a product to be cooled and forming one of two walls of an annular refrigerant cavity within the container;

an outer wall enclosing and joined to said inner wall at the upper rim thereof, said outer wall forming the other wall of said refrigerant cavity, which cavity increases in volume from top to bottom;

a base connected to said outer wall of the refrigerant cavity;

a resilient diaphragm disposed on said base and forming a diaphragm cavity with said base; and a fluid refrigerant disposed within and filling said refrigerant cavity between said inner and outer walls.

2. A container as defined in claim 1 in the general shape of a drinking glass, wherein:

the inner wall is generally fructo-conical in shape;

the outer wall is generally cylindrical in shape; and the resilient diaphragm is generally hemispherical in shape and upwardly convex.

3. A container as defined in claim 1 in the general shape of a bowl, wherein;

the inner wall is generally fructo-conical in shape;

the outer wall is generally cylindrical in shape; and the resilient diaphragm is in the general shape of an annular cylinder and upwardly convex.

4. A container as defined in claim 1 in the general shape of a wine glass, wherein:

the inner wall is generally hemispherical in shape and upwardly concave;

the outer wall is generally fructo-conical in shape and upwardly concave; and the resilient diaphragm is generally cylindrical in shape and upwardly convex.

5. A container as defined in claim 1 wherein said base is connected to said outer wall at an annular junction between said outer wall and an annular flange ascending from said base.

6. A container as defined in claim 1 wherein said base and said outer wall are formed from a single piece of material.

7. A container as defined in claim 1 wherein said base includes:

means defining one or more refrigerant ports providing communication between the ambient atmosphere and said refrigerant cavity; and a plug in each of said ports for sealing said refrigerant cavity.

8. A container as defined in claim 7 including means defining at least one air port in said base providing communication between the ambient atmosphere and said diaphragm cavity.

9. A container as defined in claim 1 wherein said fluid refrigerant is an aqueous solution.

10. A container as defined in claim 1 wherein said resilient diaphragm is a cup-shaped unit.

11. A container as defined in claim 1 wherein said resilient diaphragm is a bellows.

12. In a container for food or beverage, the combination of:

an outer shell having an open upper end and a closed lower end;

an inner liner having an open upper end and a closed lower end and positioned within and spaced from said outer shell defining a first fluid space therebetween;

said outer shell and inner liner including interengageable means for a liquid-tight seal therebetween adjacent the upper end thereof;

a generally cup shaped stress unit of a deformable material and positioned in said first fluid space defining a second fluid space between said stress unit and said outer shell; and a chillable liquid in said first fluid space.

13. A container as defined in claim 10 wherein said outer shell comprises a sleeve and a base, with said base joined to said sleeve in a fluid-tight relation, with said base having a first opening providing communication with said first fluid space and a second opening providing communication with said second fluid space.

14. A container as defined in claim 11 wherein said chillable liquid is an aqueous solution substantially filling said first fluid space.

* * * * *